US006923694B2

(12) United States Patent
Ishigaki

(10) Patent No.: US 6,923,694 B2
(45) Date of Patent: Aug. 2, 2005

(54) WATERJET PROPELLING DEVICE OF BOAT

(75) Inventor: Eiichi Ishigaki, Sakaide (JP)

(73) Assignee: Ishigaki Company Limited, Tokyo (JP)

( * ) Notice: Subject to any disclaimer, the term of this patent is extended or adjusted under 35 U.S.C. 154(b) by 0 days.

(21) Appl. No.: 10/492,544

(22) PCT Filed: Oct. 30, 2002

(86) PCT No.: PCT/JP02/11286

§ 371 (c)(1),
(2), (4) Date: Apr. 27, 2004

(87) PCT Pub. No.: WO03/037713

PCT Pub. Date: May 8, 2003

(65) Prior Publication Data

US 2005/0014426 A1 Jan. 20, 2005

(30) Foreign Application Priority Data

Nov. 1, 2001 (JP) ..... 2001-336212

(51) Int. Cl.[7] ..... B63H 11/00
(52) U.S. Cl. ..... 440/38; 416/223 R
(58) Field of Search ..... 440/38; 416/223 R

(56) References Cited

U.S. PATENT DOCUMENTS

| | | | | |
|---|---|---|---|---|
| 3,082,732 A | | 3/1963 | Stallman | |
| 5,108,257 A | * | 4/1992 | Fukazawa et al. | 415/182.1 |
| 5,876,257 A | * | 3/1999 | Lin | 440/38 |
| 6,135,831 A | | 10/2000 | Lanni et al. | |
| 6,645,018 B2 | | 11/2003 | Ishigaki et al. | |
| 6,752,671 B2 | | 6/2004 | Ishigaki et al. | |
| 2003/0056704 A1 | | 3/2003 | Ishigaki et al. | |
| 2003/0104733 A1 | | 6/2003 | Ishigaki et al. | |
| 2004/0067133 A1 | | 4/2004 | Ishigaki et al. | |

FOREIGN PATENT DOCUMENTS

| | | |
|---|---|---|
| JP | 1-104898 | 7/1989 |
| JP | 3-67097 | 3/1991 |
| JP | 8-253196 | 10/1996 |
| JP | 10-59287 | 3/1998 |
| JP | 11-70894 | 3/1999 |
| JP | 2000-118494 | 4/2000 |

OTHER PUBLICATIONS

English Language Abstract of JP 3–67097.
English Language Abstract of JP 10–59287.
English Language Abstract of JP 11–70894.
English Language Abstract of JP 2000–118494.
English Language Abstract of JP 8253196.

* cited by examiner

*Primary Examiner*—Jesus D. Sotelo
(74) *Attorney, Agent, or Firm*—Greenblum & Bernstein, P.L.C.

(57) ABSTRACT

Rotary vanes having inducer-joined axial-flow vane portions, mixed-flow vane portions collisionlessly connected to the axial-flow vane portions, and centrifugal vane portions collisionlessly connected to the mixed-flow vane portions are wound around an outer peripheral surface of a hub that is continuously curved. The hub is configured with a moderate slope region and a steep slope region. The axial-flow vane portions and the mixed-flow vane portions are wound around the moderate slope region, and the centrifugal vane portions being wound around the steep slope region.

6 Claims, 13 Drawing Sheets

WATERJET PROPELLING DEVICE OF BOAT

TECHNICAL FIELD

The present invention relates to a waterjet propelling apparatus for vessels, and particularly to a waterjet propelling apparatus for vessels, suitable for high-speed vessels relatively large in scale.

BACKGROUND ART

Waterjet propelling apparatus for vessels is configured as a turbopump with an impeller for pressurizing water drawn from a suction port open at the bottom of a vessel, converting into swirling streams, and a diffuser for rectifying the swirling streams into straight streams, to discharge thus obtained waterjets from a discharge part at the stern, thereby propelling the vessel.

Table-1 lists fundamental impeller types and typical characteristics of turbopumps.

TABLE 1

Fundamental Impeller Types and Typical Characteristics

| Types | Centrifugal | Mixed flow | Axial flow |
|---|---|---|---|
| Outflow direction | Radial | Diagonal | Axial |
| Head provider | CF*1 | CF*1 + VPF*2 | VPF*2 |
| Head, H | High | Moderate | Low |
| Delivery, Q | Small | Moderate | Large |
| Specific speed, Ns | 100 to 150 | 350 to 1,100 | 1200 to 2000 |
| Meridian contour | C1, C2 of FIG. 11 | C3 to C6 of FIG. 11 | C7 of FIG. 11 |

*1CF = centrifugal force,
*2VPF = vane's pumping force

As shown in the Table-1, the impeller of turbopump is classifiable into three fundamental types according to the outflow direction of pumped liquid. In other words, a centrifugal type has an outflow direction substantially perpendicular to the axis of rotational, which is radial; a mixed flow type has an outflow direction diagonal to the axis of rotation; and an axial flow type has an outflow direction substantially parallel to the axis of rotation. In the axial flow type, liquid flows in an axial direction, receiving axial pumping forces from the vanes of the impeller, and obtaining a head principally therefrom. In the mixed flow type, flowing liquid has radial moving components and receives commensurate centrifugal forces, as well as pumping forces from vanes, thereby obtaining a head. In the centrifugal type, liquid flows in radial directions, receiving centrifugal forces, and obtaining a head principally therefrom. Accordingly, in general, the centrifugal type has high head and small delivery. In contrast, the axial flow type has low head and large delivery. The mixed flow type falls somewhere in between.

In this respect, the outflow direction of pumped liquid depends on changes in the radial direction of liquid channels. The radial changes of channels can be seen with ease, by observing a meridian map of the channels, i.e., a meridian channel (hereafter sometimes called "M-channel").

The meridian map is a rotational mapping of a body of rotation onto a meridian plane (i.e., a plane that includes the axis of rotation). In the case of turbopump, it appears as a meridian contour (hereafter sometimes called "M-contour"), where the impeller and a casing that constitutes a shroud of one or more channels have their inside contours (which actually extend in a circumferential direction with their curvilinear changes) circumferentially projected on a plane including an axis of the impeller, there being manifested an angular change.

The M-contour can be generally specified by a non-dimensional parameter called "specific speed". The specific speed corresponds to a required number of revolutions (rpm) of a turbopump for delivery of a unit flow rate (1 $m^3$/min) of liquid pumped to a unit head (1 m). Now, letting Q ($m^3$/min) be a delivery flow at a designed number of revolutions N (rpm), and H (m) be a total head, the specific speed Ns of the turbopump can be expressed such that:

$$Ns=N\cdot Q^{1/2}/H^{3/4}.$$

For conventional turbopumps, FIG. 12 shows a relationship between the specific speed Ns and exemplary M-contours MC1 to MC7. As is apparent from FIG. 12, for the centrifugal type (MC1, MC2) to be large in H and small in Q, the Ns can be as small as ranging approx. 100 to approx. 150, however for the axial flow type (MC7) to be small in H and large in Q, the Ns can be as large as ranging approx. 1,200 to approx. 2,000. For the mixed flow type (MC3 to MC6), the Ns can decrease from approx. 550 to approx. 350, as the outflow direction of pumped liquid approaches (MC3←MC4) a radial direction, or on the contrary can increase from approx. 600 to approx. 1,100, as the outflow direction of pumped liquid approaches (MC5→MC6) an axial direction. M-contours, e.g., MC1 and MC2, of impellers of the centrifugal type define M-channels, e.g., mp1 and mp2, extending in a radial direction at their delivery ends. M-contours, e.g., MC3 to MC6, of impellers of the mixed flow type define M-channels, e.g., mp3 to mp6, diagonal to the axis of rotation at their delivery ends. M-contours, e.g., MC7, of impellers of the axial flow type define M-channels, e.g., mp7, substantially parallel to the axis of rotation at their delivery ends.

Japanese Patent Application Laying-Open Publication No. 11-70894 has disclosed a waterjet propelling apparatus for vessels using an axial flow type of impeller with a cylindrical impeller casing. This waterjet propelling apparatus can discharge a large amount of waterjets with a relatively low pressure, and is suitable for propelling large-scale low-speed vessels.

Japanese Patent Application Laying-Open Publication No. 2000-118494 has disclosed a waterjet propelling apparatus for vessels using a mixed flow type of impeller with a drum-shaped impeller casing. This waterjet propelling apparatus can discharge waterjets higher in pressure, but inferior in flow rate, relative to the use of axial flow impeller, and is suitable for propelling middle-speed vessels small or middle in scale.

Japanese Utility Model Application Laying-Open Publication No. 1-104898 has disclosed a waterjet propelling apparatus for vessels, using a combination of a front stage booster and a mixed flow type of impeller. This waterjet propelling apparatus can discharge boosted waterjets with a fraction of contribution by the booster, and is suitable to middle-speed vessels small or middle in scale and high-speed vessels small in scale.

Japanese Patent Application Laying-Open Publication No. 8-253196 has disclosed a waterjet propelling apparatus of an outboard type using a centrifugal type of impeller. This waterjet propelling apparatus can discharge waterjets still higher in pressure, but still inferior in flow rate, relative to the use of mixed flow impeller, and is suitable to small-scale high-speed vessels.

FIG. 13 shows, in a meridian map, a mixed flow type of impeller IMP-0 used in a conventional waterjet propelling apparatus for vessels. This impeller IMP-0 is configured with a rotary hub 115 in a frustum shape of a right circular cone, and a plurality of rotary vanes 116 wound around the hub 115. The hub 115 has an outer periphery 115*a* extending from an upstream (i.e., small-diameter end) edge 115*b* thereof to a downstream (i.e., large-diameter end) edge 115*c* thereof, at a maintained angle up to a vicinal part 115*d* to the downstream edge 115*c* within a range of about 15° to 30° relative to a rotation axis CL of the hub 115, and at a varied angle from the vicinal part 115*d* within a range of about 0° to 22°. Respective rotary vanes 116 have, as they are in the meridian map, an inner peripheral edge part 116*a* extending along the hub outer periphery 115*a*, and an outer peripheral edge 116*b* extending at a maintained angle within a range of about 0° to 22° relative to the rotation axis CL. This vane configuration improves the head and flow rate of mixed flow impeller to some extent that is yet insufficient for application to high-speed vessels relatively large in scale.

The present invention has been made with the foregoing points in view. It therefore is an object of the invention to provide a waterjet propelling apparatus for vessels applicable even to a high-speed vessel relatively large in scale.

DISCLOSURE OF INVENTION

To achieve the above-noted object, the present invention provides a waterjet propelling apparatus for vessels, configured as a single-staged turbopump including an impeller having rotary vanes wound around a hub, wherein a rotary vane comprises an axial-flow vane portion with an inducer-joined configuration, a mixed-flow vane portion collisionlessly connected to the axial-flow vane portion, and a centrifugal vane portion collisionlessly connected to the mixed-flow vane portion, the hub has, in an outer peripheral surface thereof continuously varying in curvature, a moderate slope region and a steep slope region, the axial-flow vane portion and the mixed-flow vane portion of the rotary vane are wound around the moderate slope region of the outer peripheral surface of the hub, and the centrifugal vane portion of the rotary vane is wound around the steep slope region of the outer peripheral surface of the hub.

Preferably, the moderate slope region of the outer peripheral surface of the hub is located upstream the steep slope region.

Preferably, a pump casing configured to accommodate the impeller is provided, and the axial-flow vane portion of the rotary vane has an inducer part confronting a downstream end of a straight-tubular portion of the pump casing.

Preferably, a suction path, moderate of slope, is provided.

Preferably, the rotary vanes are 4 to 6 in total number.

Preferably, stationary vanes, 7 to 9 in total number, are disposed downstream the rotary vanes.

BEST MODE FOR CARRYING OUT THE INVENTION

Figure 1:
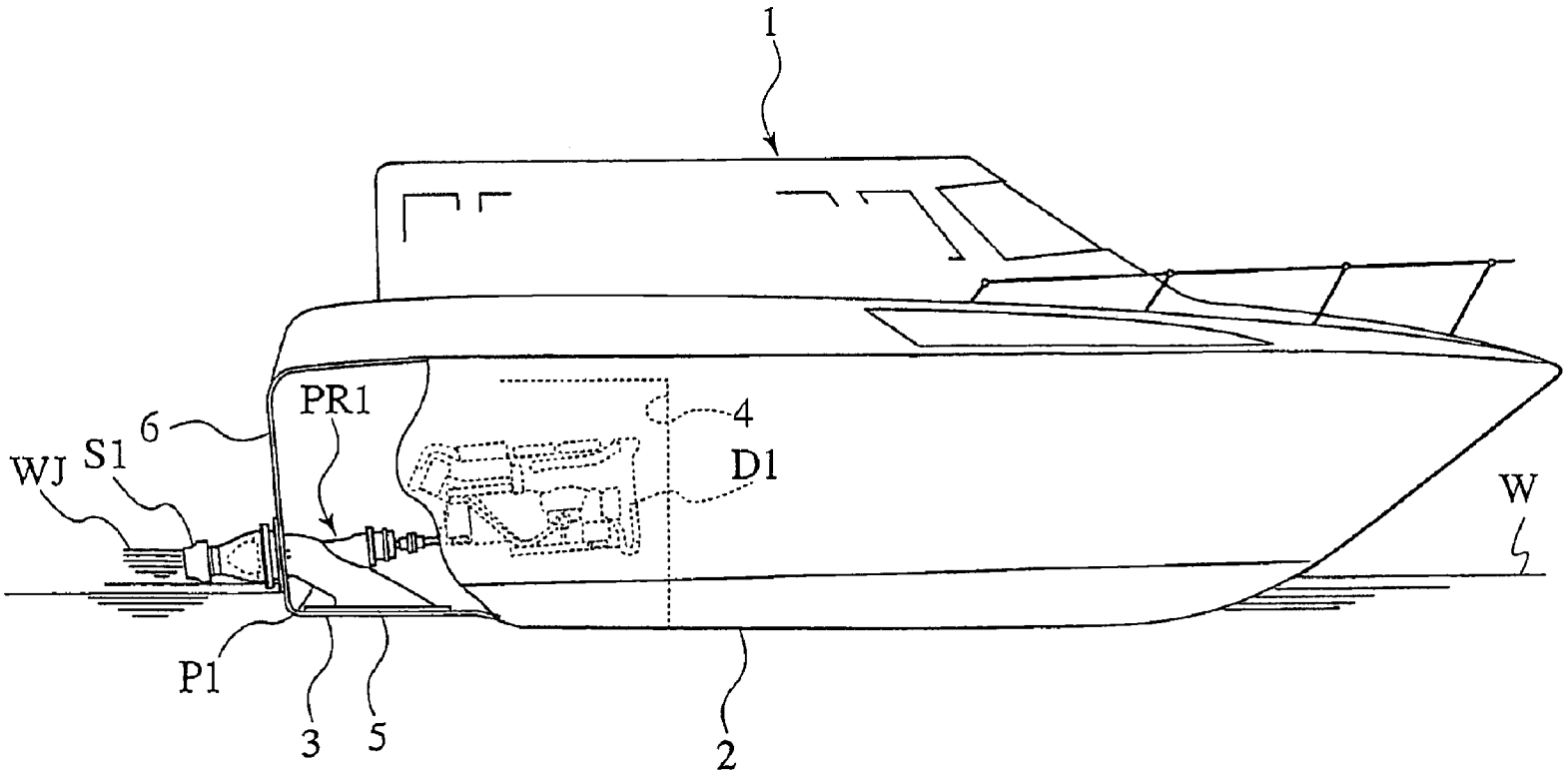
FIG. 1 is a side view of a vessel equipped with a waterjet propelling apparatus according to a first embodiment of the present invention.

There will be described below preferred embodiments of the present invention, with reference to the accompanying drawings. Description will be firstly made of a first embodiment of the invention based on FIGS. 1 to 7, and a first and a second modification of the first embodiment based on FIGS. 8 and 9, and secondly, of a second embodiment of the invention based on FIGS. 10 and 11. Like elements are designated by like reference characters, omitting redundancy.

(First Embodiment)

FIG. 1 shows, as a cruiser relatively large in scale, a high-speed vessel 1 equipped with a waterjet propelling apparatus PR1 according to a first embodiment, and FIGS. 2 to 5 show progressively enlarged views of an essential portion of the waterjet propelling apparatus PR1.

The waterjet propelling apparatus PR1 is configured, as shown in FIG. 1, with a turbopump portion 1 for converting drawn water W from a suction port 5 open at a rear portion 3 of a vessel bottom 2 of the vessel 1, into waterjets WJ, to deliver waterjets WJ rearwardly of a transom of the stem 6, an engine as a drive portion D1 provided in an engine room 4 to drive the turbopump portion 1, and a steering portion S1 for controlling a discharge direction of delivered waterjets WJ to steer the vessel 1 (with unshown controlling system and steering system).

Figure 2:
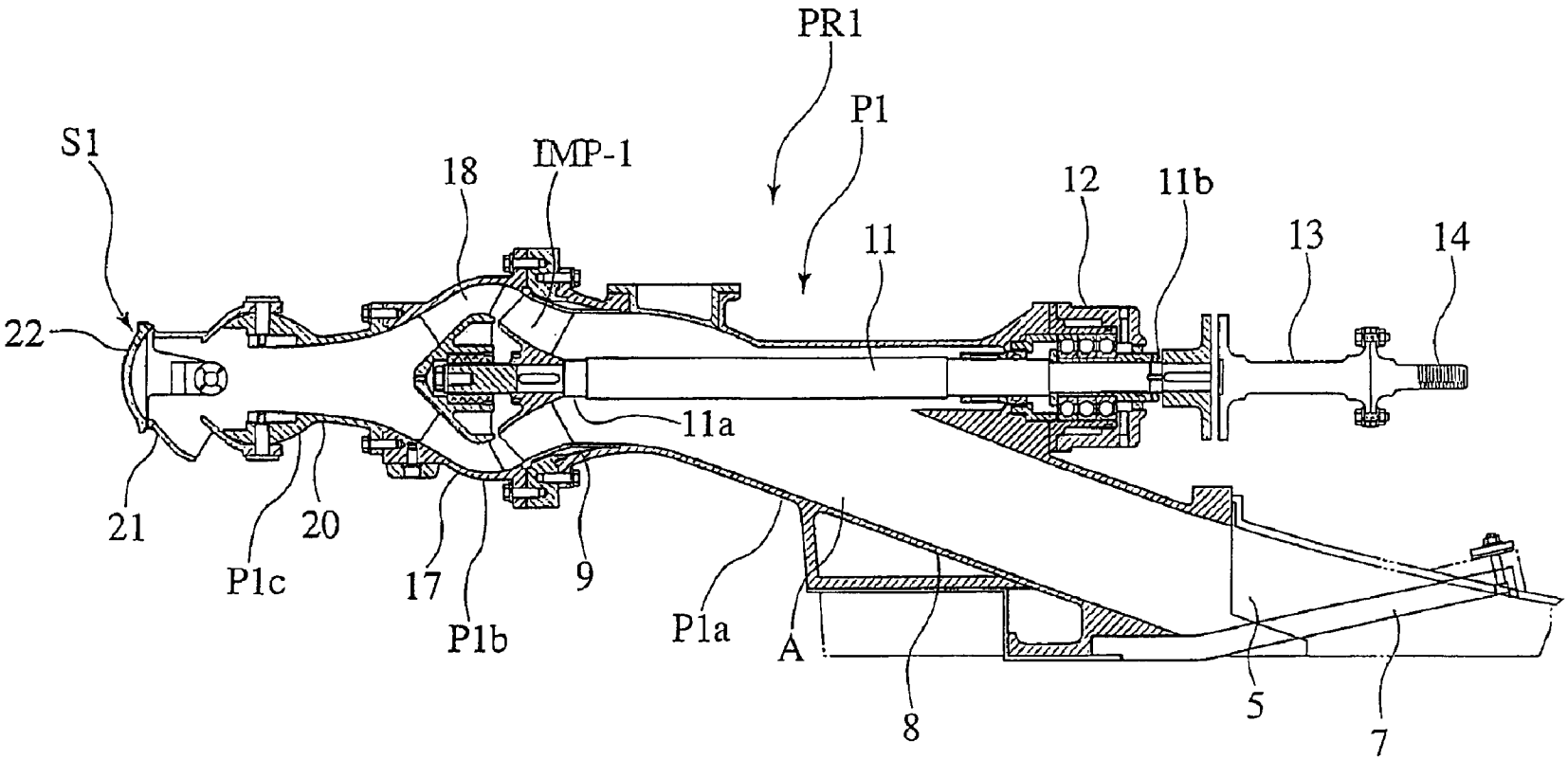
FIG. 2 is a longitudinal cross-sectional view of the waterjet propelling apparatus shown in FIG. 1.

As shown in FIG. 2, the turbopump portion P1 includes a water drawing part P1*a* for drawing water W from the suction port 5, a waterjet generating part P1*b* for generating waterjets WJ from drawn water W, and a waterjet delivery part P1*c* for delivering generated waterjets WJ.

The water drawing part P1*a* has a suction casing 8 to thereby define a suction path A communicating with the suction port 5. This suction path A is moderate in slope, smooth, and less curved, to introduce flowing water when the vessel 1 planes, exerting force-feed pressures on drawn water W. Note that the suction port 5 has a dust removing screen 7 extending thereover.

Figure 3:
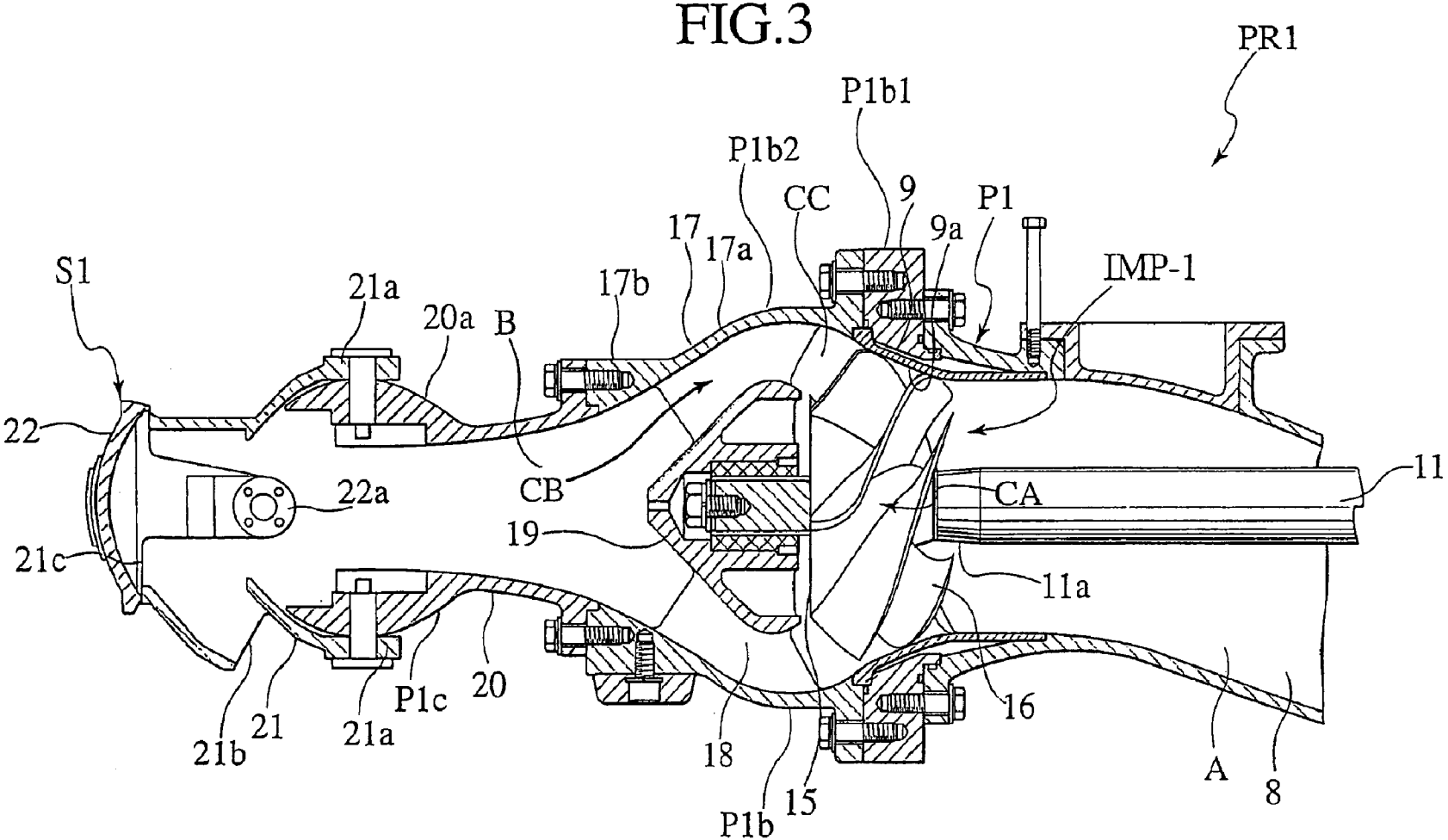
FIG. 3 is an enlarged view of an essential portion of the waterjet propelling apparatus of FIG. 2.

As shown in FIG. 3, the waterjet generating part P1*b* is configured with a swirling part P1*b*1 for swirling drawn water W to be pressurized to thereby generate swirling streams high of head, and a rectifying part P1*b*2 as a diffuser for rectifying swirling streams into straight streams, to obtain waterjets WJ.

Figure 4:
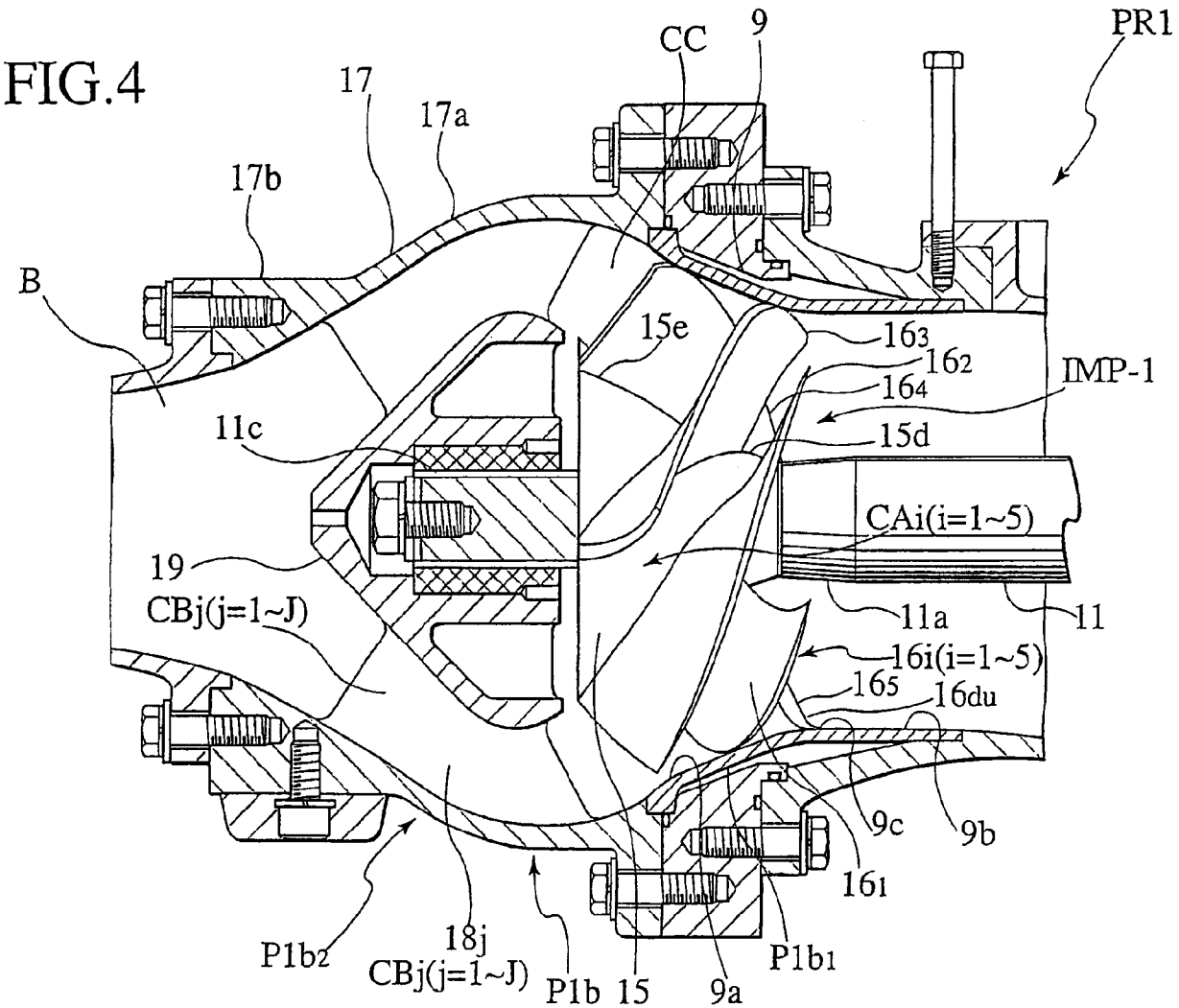
FIG. 4 is a detailed view of an essential portion of the waterjet propelling apparatus of FIG. 3, including a five-vane impeller and a diffuser.
Figure 5:
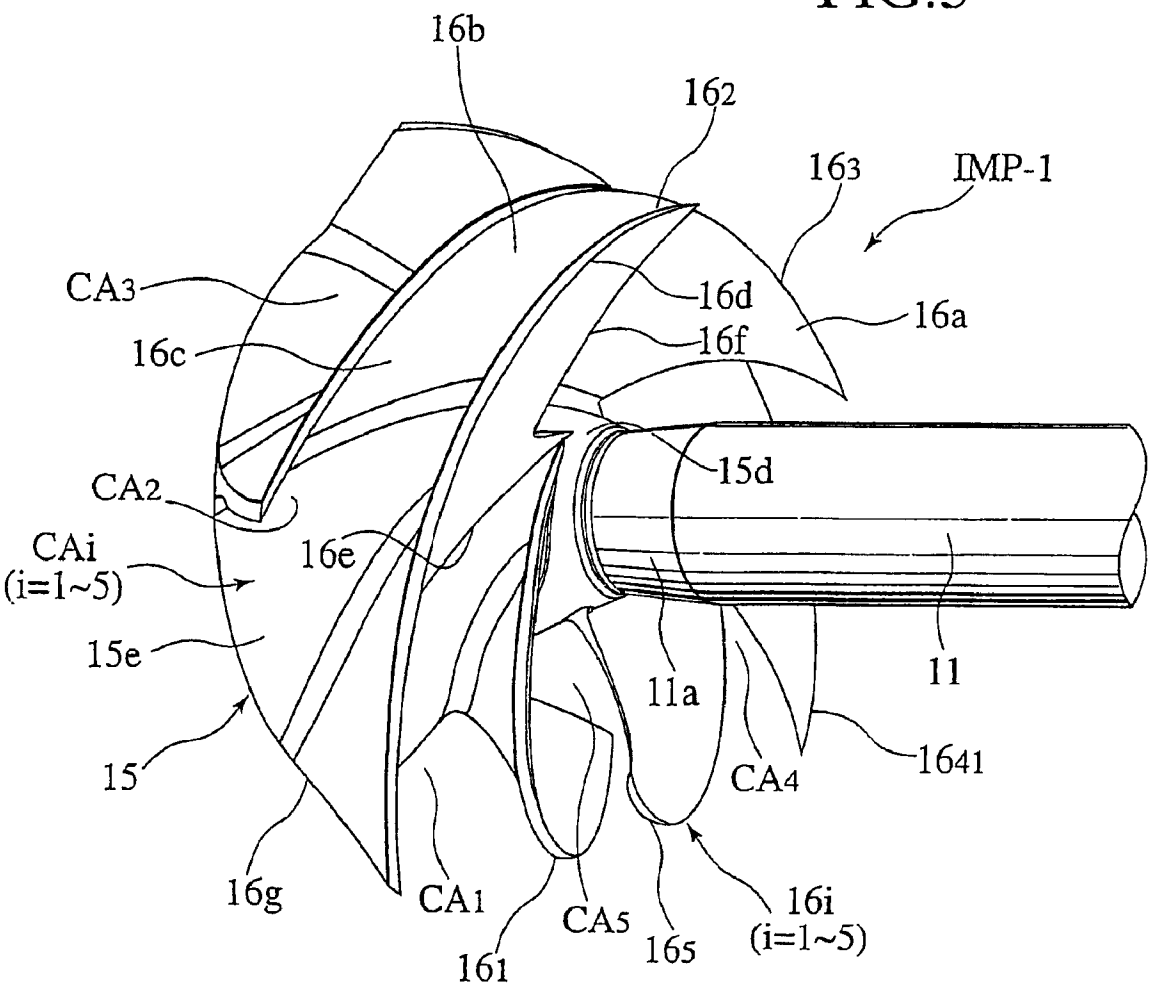
FIG. 5 is a perspective view of the impeller shown in FIG. 4.

As shown in FIGS. 4 and 5, the swirling part P1*b*1 has a pump casing 9 horizontally coupled to a rear end of the suction casing 8, an impeller IMP-1 installed in a bowl-shape diameter-expanded part 9*a* of the pump casing 9, and a spindle 11 for driving the impeller IMP-1.

The impeller IMP-1 includes a pear-shaped hub 15 keyed to a rear part 11*a* of the spindle 11, and a total number of I (I=5 in this case) spiral rotary vanes $\mathbf{16}_i$ (i=1 to I) (collectively, designated simply by 16) integrally formed on an outer periphery of the hub 15, for cooperation with the pump casing 9 as a shroud to define a total number of I rotary channels $CA_i$ (i=1 to I) (collectively, designated simply by CA).

As shown in FIG. 2, the spindle 11 is water-sealingly borne by a bearing 12 provided on an outer wall of the suction casing 8, and has a front part 11*b* protruding therefrom to be coupled with a drive shaft 14 of the drive portion D1 via a shaft coupling 13.

As shown in FIG. 4, the rectifying part P1*b*2 has a front part 17*a* of a delivery casing 17 coupled to the rear end of suction casing 8, a total number of J (J=7 to 9) stationary guide vanes $\mathbf{18}_j$ (j=1 to J)(collectively, designated simply by 18) integrally formed with the delivery casing front part 17*a*, and a vane boss 19 interconnecting inner peripheral parts of the stationary guide vanes 18 and bearing the rear end part 11*c* of the spindle 11. The guide vanes 18 cooperate with the pump casing 9 and vane boss 19 to define a total number of J stationary channels $CB_j$ (j=1 to J) (collectively, designated simply by CB). The stationary channels CB communicate with the rotary channels CA via a conflux channel CC.

As shown in FIG. 3, the waterjet delivery part P1*c* is configured with a rear part 17*b* of the delivery casing 17, and a funnel-shaped delivery nozzle 20 fastened to the rear part 17*b*, to define a delivery path B communicating with the stationary channels CB.

As shown in FIG. 3, the steering portion S1 includes a deflector 21 laterally rotatably pivoted on a delivery end part 20*a* of the delivery nozzle 20 by upper and lower pins 21*a*, a rod (not shown) for steering the deflector 21 leftward and rightward, a reverser 22 vertically rotatably pivoted by pins 22*a* protruding from left and right parts of the deflector 21, and a control rod (not shown) for changing over a vertical rotary position of the reverser 22 between a vessel-advancing normal position for closing an obliquely forwardly directed discharge port 21*b* of the deflector 21, and a vessel-backing reverse position for closing a rearwardly directed discharge port 21*c* of the deflector 21.

Figure 6:
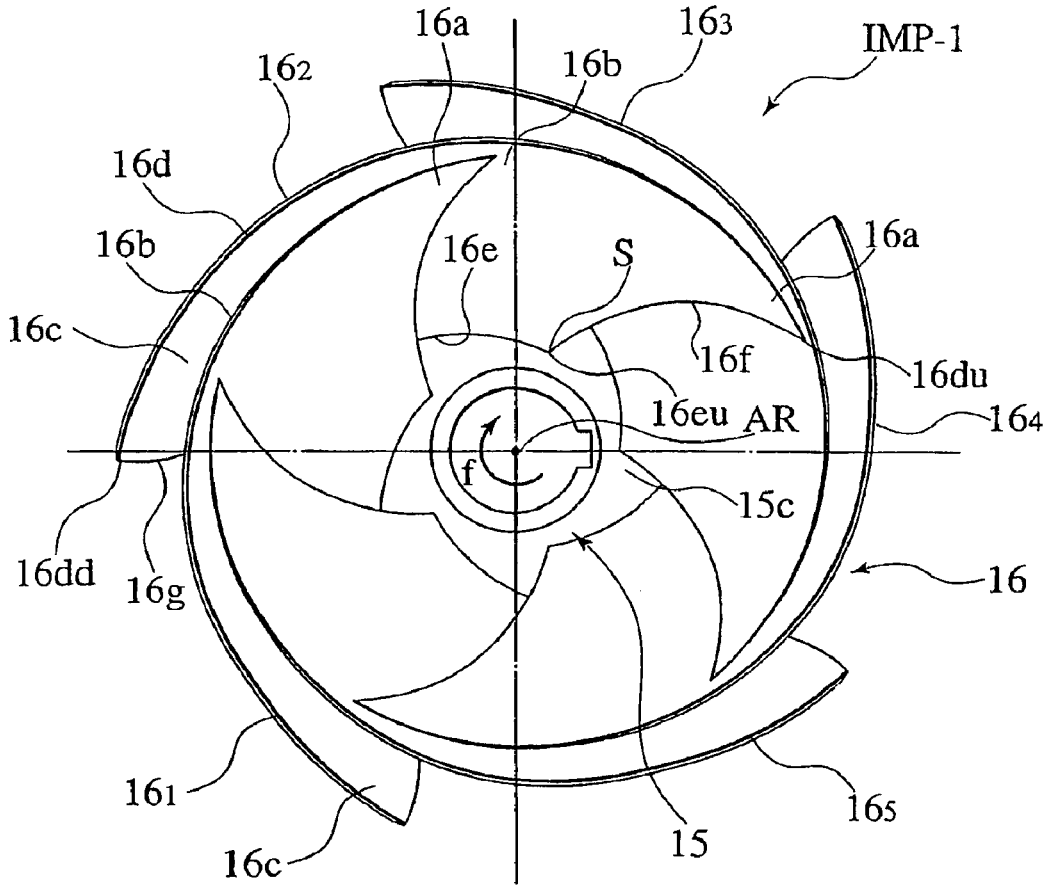
FIG. 6 is a front view of the impeller of FIG. 5.
Figure 7:
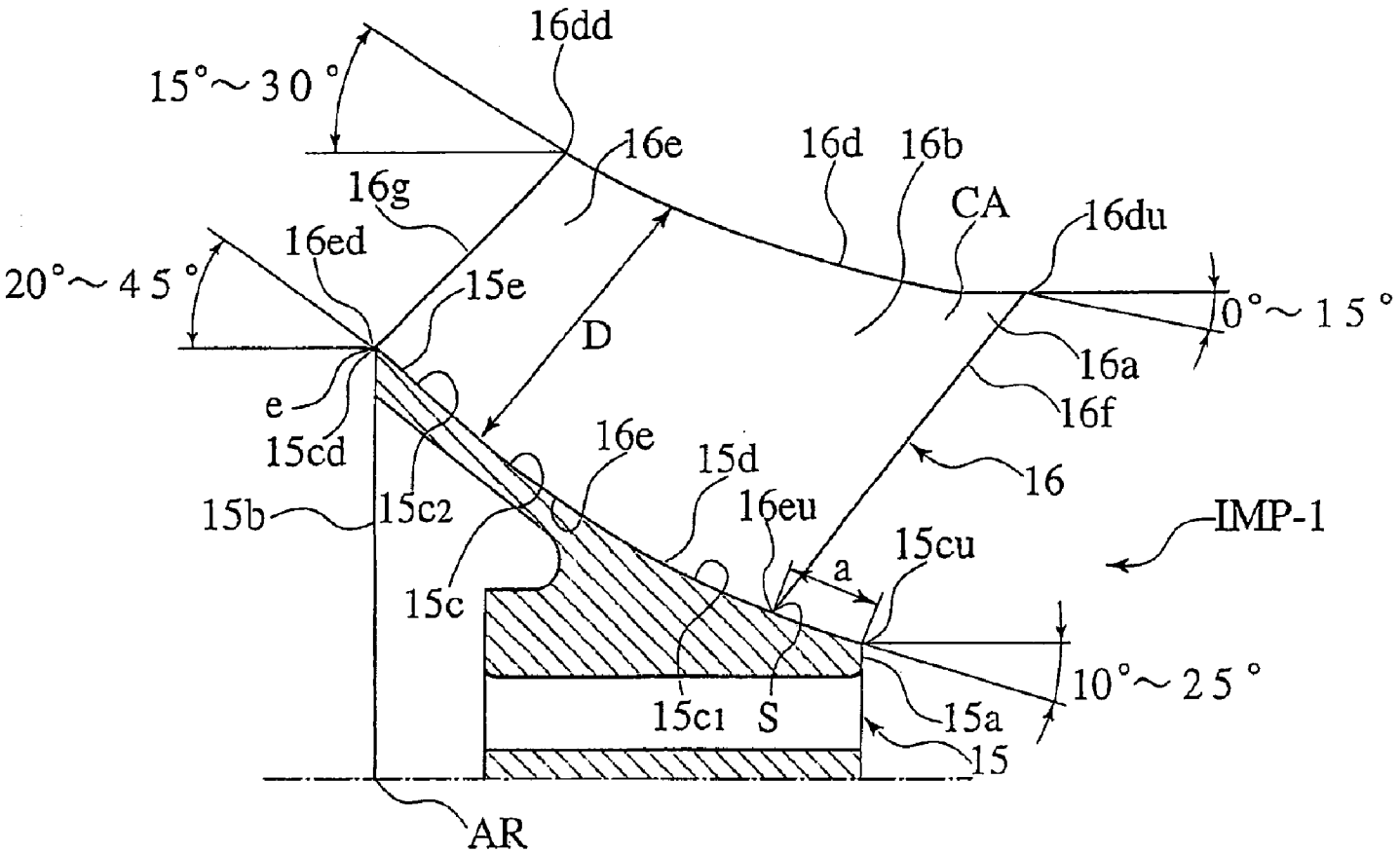
FIG. 7 is a meridian map of the impeller of FIG. 5.

There will be described below vane configuration of the impeller IMP-1 with reference to FIGS. 5 to 7. FIG. 5, FIG. 6 and FIG. 7 are a perspective view, a front view and a meridian map of the impeller IMP-1, respectively.

As shown in FIG. 5 and FIG. 6, the impeller IMP-1 has a structure configured with five spiral rotary vanes $\mathbf{16}_i$ (i=1 to 5) axis-symmetrically wound and fixed on the funnel-shaped hub 15. Respective rotary vanes 16 have, as they are in a meridian map, the shape of an irregular quadrilateral form curved, as in FIG. 7, along the pump casing 9 (FIG. 4) and the hub 15. Namely, each vane 16 in the meridian map is shaped in a curved irregular quadrilateral form defined by an outer side 16*d* curved along the inner periphery of the pump casing 9, an inner side 16*e* curved along an outer periphery 15*c* of the hub 15, an interconnecting side 16*f* between upstream ends 16*du*, 16*eu* of the outer and inner sides 16*d*, 16*e*, and an interconnecting side 16*g* between downstream ends 16*dd*, 16*ed* of the outer and inner sides 16*d*, 16*e*.

The inner side 16*e* has, within the outer peripheral surface 15*c* diverging or diameter expansion from an upstream end 15*a* to a downstream end 15*b* of the hub 15, a starting point s thereof (i.e., the upstream end 16*eu*) as a point in the midway of an upstream region 15*c*1 relatively moderate in inclination to a rotation axis AR (more specifically, at a retreat position from an upstream edge 15*cu* by a predetermined distance d along the outer periphery 15*c*), and an ending point e thereof (i.e., the downstream end 16*ed*) as a point at-the rear end of a downstream region 15*c*2 relatively steep in inclination (i.e., on a downstream edge 15*cd* of the hub 15). Note that the hub outer periphery 15*c* is formed collision-less (i.e., continuous in curvature) over an entire region thereof including the upstream region 15*c*1 and the downstream region 15*c*2. In this respect, the hub outer periphery 15*c* is inclined to the rotation axis AR, at an angle within a range of 10° to 25° on the upstream end 15*cu* and at an angle within a range of 20° to 45° on the downstream end 15*cd*.

The outer side 16*d* has a progressively increased distance D relative to the inner side 16*e*, as it extends from the downstream end 16*dd* to the upstream end 16*du*. Therefore, the angle of inclination to the rotation axis AR is set as wide as ranging from 15° to 30° at the downstream end 16*dd*, but as narrow as ranging from 0° to 15° at the upstream end 16*du*. In addition, the downstream side 16*g* as well as the upstream side 16*f* forwardly obliquely extends from the outer periphery 15*c* in a slightly protruding manner, so that as in FIG. 4 the upstream end 16*du* protrudes upstream, confronting a vicinity of a rear end 9*c* of a straight-tubular front part 9*b* of the pump casing 9. Further, each rotary vane 16 has a front-view configuration in which the upstream side 16*f* extends, as in FIG. 6, from the upstream end 16*eu* (the starting point s on the hub outer periphery 15*c*) of the inner side 16*e*, arcuately in the direction of a forward rotation f of the hub 15.

Namely, each rotary vane 16 is configured with an inducer-joined axial-flow vane portion (hereinafter simply called "inducer vane portion") 16*a* extending from a downstream vicinity of the starting point s on the hub outer periphery 15*c* (i.e., from a vicinal part to the upstream end of the moderate slope region 15*c*1 in FIG. 7), like the shape of a hawk's talon, i.e., in a screw shape in front view (FIG. 6), having its distal end 16*du* confronting in side view (FIG. 4) the vicinity of the rear end 9*c* of the straight-tubular front part 9*b* of the pump casing 9, a mixed-flow vane portion 16*b* standing from the remaining part of the moderate slope region 15*c*1 of the hub outer periphery 15*c* for collision-less connection to the inducer vane portion 16*a*, and a centrifugal vane portion 16*c* standing from the steep slope region 15*c*2 (FIG. 7) for collision-less connection to the mixed-flow vane portion 16*b*.

Note that the inducer vane portion 16*a* may be regarded as a combination of an inducer part positioned upstream the starting point s and thus separated from the hub 15(as a triangular curve part defined by the upstream side 16*f*), and an axial-flow vane part standing from the downstream vicinity of the starting point s and connected collision-less to the inducer part.

For the moderate slope region 15*c*1 and the steep slope region 15*c*2 of the hub outer periphery 15*c*, where the curvature is continuously changed, it is unnecessary in design to specify the position of a boundary therebetween. It however is possible to assume a boundary residing between a branching point between a shaft part of the hub 15 shown in FIG. 7 and an umbrella part diverging therefrom for diameter expansion, and a rear end face of the hub shaft part.

As a combination of a part of hub 15 extending from the upstream end 15*a* to the starting point s on the outer periphery 15*c* and a part of moderate slope of upstream region 15*c*1 is referred to as a front stage portion 15*d*, and a part of steep slope extending downstream thereof is referred to as a rear stage portion 15*e*, the mixed-flow vane portion 16*b* is wound and fixed on the hub front stage portion 15*d*, having the upstream end 16*du* of the inducer vane portion 16*a* as an upstream part thereof protruding frontward (upstream), exceeding the hub front stage portion 15*d* as in FIG. 4. The centrifugal vane portion 16*c* is wound and fixed on the hub rear stage portion 15*e*.

The outer side 16*d* of rotary vane 16 is brought close to an inner periphery of the pump casing 9, to improve the volumetric efficiency. The inducer vane portion 16*a* is extended into the suction path A, defining inside a wide inflow opening to avoid binding such as of fibers. Further, by virtue of the inducer function, the amount of drawn water W is increased, with an improved suction perormance allowing for high force-feed pressures on the mixed-flow vane portion 16*b*. Receiving the force-feed pressures, water W is pressurized by centrifugal forces from the mixed-flow vane portion 16*b* and pumping forces of the vane faces. The centrifugal vane portion 16*c* gives pressures and energy of velocity, allowing the increase of shaft horsepower to be prevented by centrifugal forces. In this way, the waterjet propelling apparatus PR1 is configured as a single-stage turbopump improved in suction performance and reduced in occurrence of cavitation as well, with an impeller having a flat shaft-horsepower characteristic facilitating the handling, allowing high speed rotation, as well as a large capacity and high-head operation.

There will be described below modifications of the first embodiment, with reference to FIG. 8 and FIG. 9.

Figure 8:
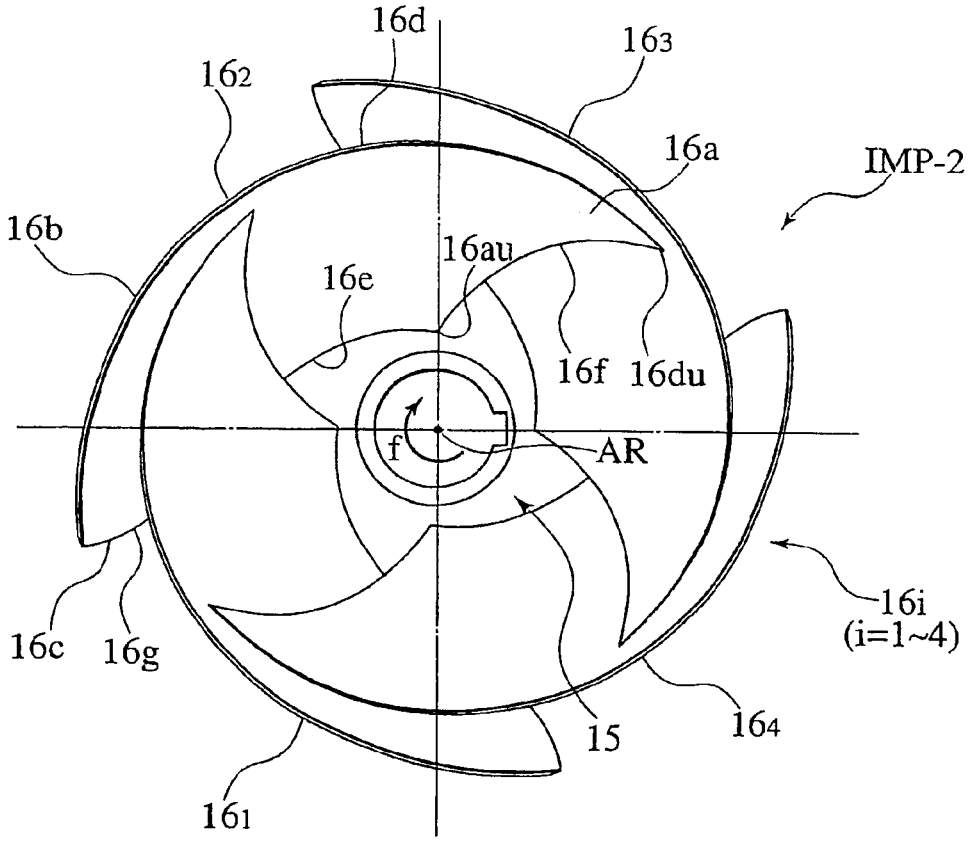
FIG. 8 is a front view of a four-vane impeller according to a first modification of the first embodiment.

FIG. 8 shows an impeller IMP-2 of a waterjet propelling apparatus for vessels according to a first modification. The first modification is different from the first embodiment in that the impeller IMP-2 has a total number of four spiral rotary vanes 16*i* (i=1 to 4).

Figure 9:
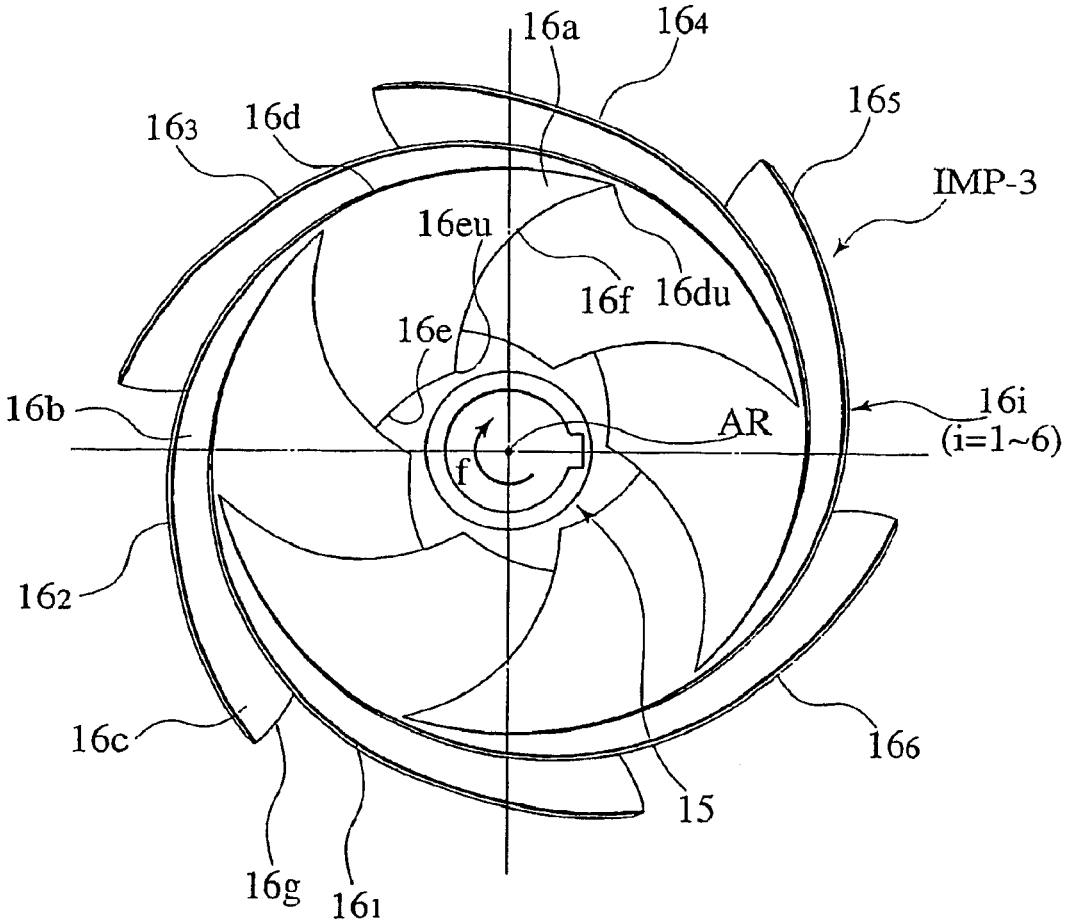
FIG. 9 is a front view of a six-vane impeller according to a second modification of the first embodiment.

FIG. 9 shows an impeller IMP-3 of a waterjet propelling apparatus for vessels according to a second modification. The second modification is different from the first embodiment in that the impeller IMP-3 has a total number of six spiral rotary vanes 16*i* (i=1 to 6).

(Second Embodiment)

There will be described below a second embodiment of the present invention, with reference to FIG. 10 and FIG. 11.

Figure 10:
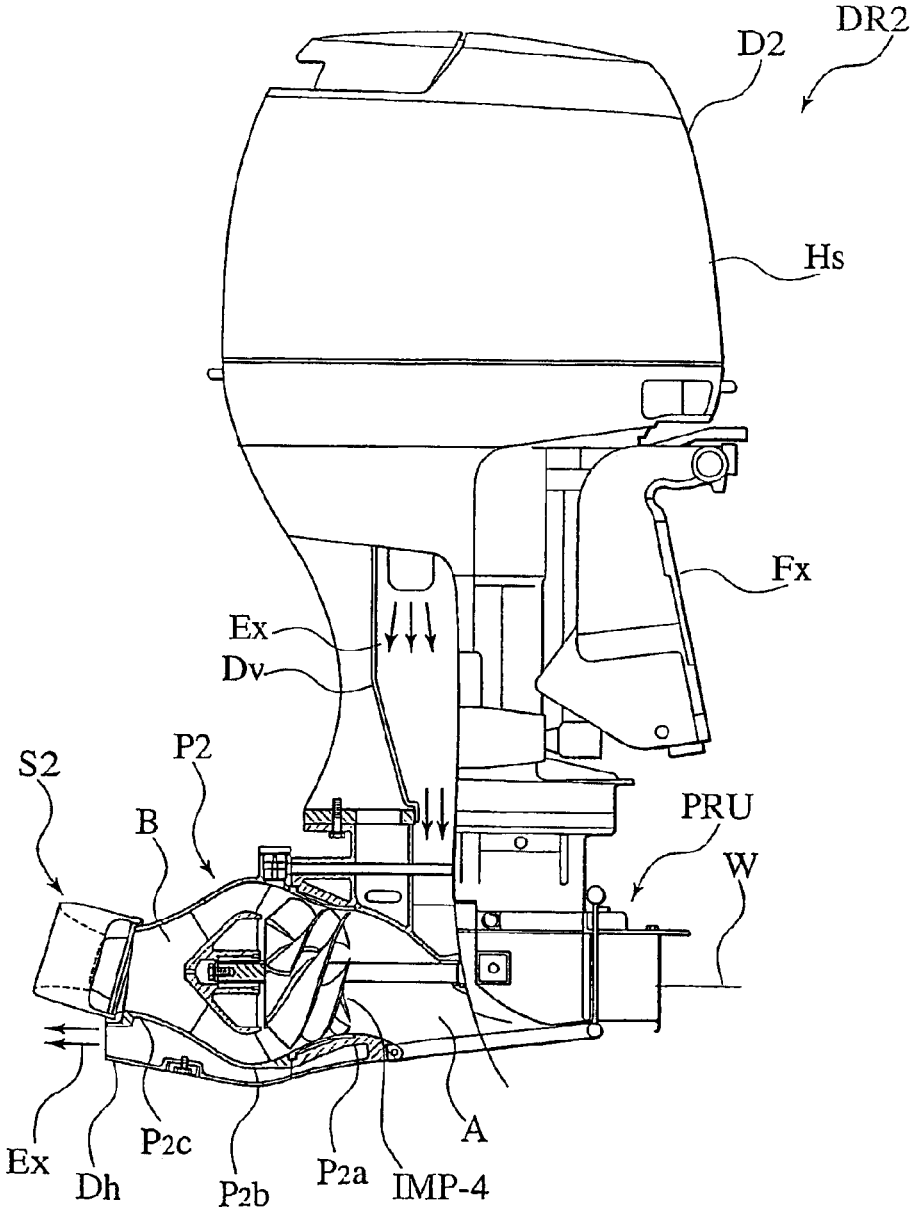
FIG. 10 is a partially cut-away side view of a waterjet propelling apparatus for vessels according to a second embodiment of the present invention.
Figure 11:
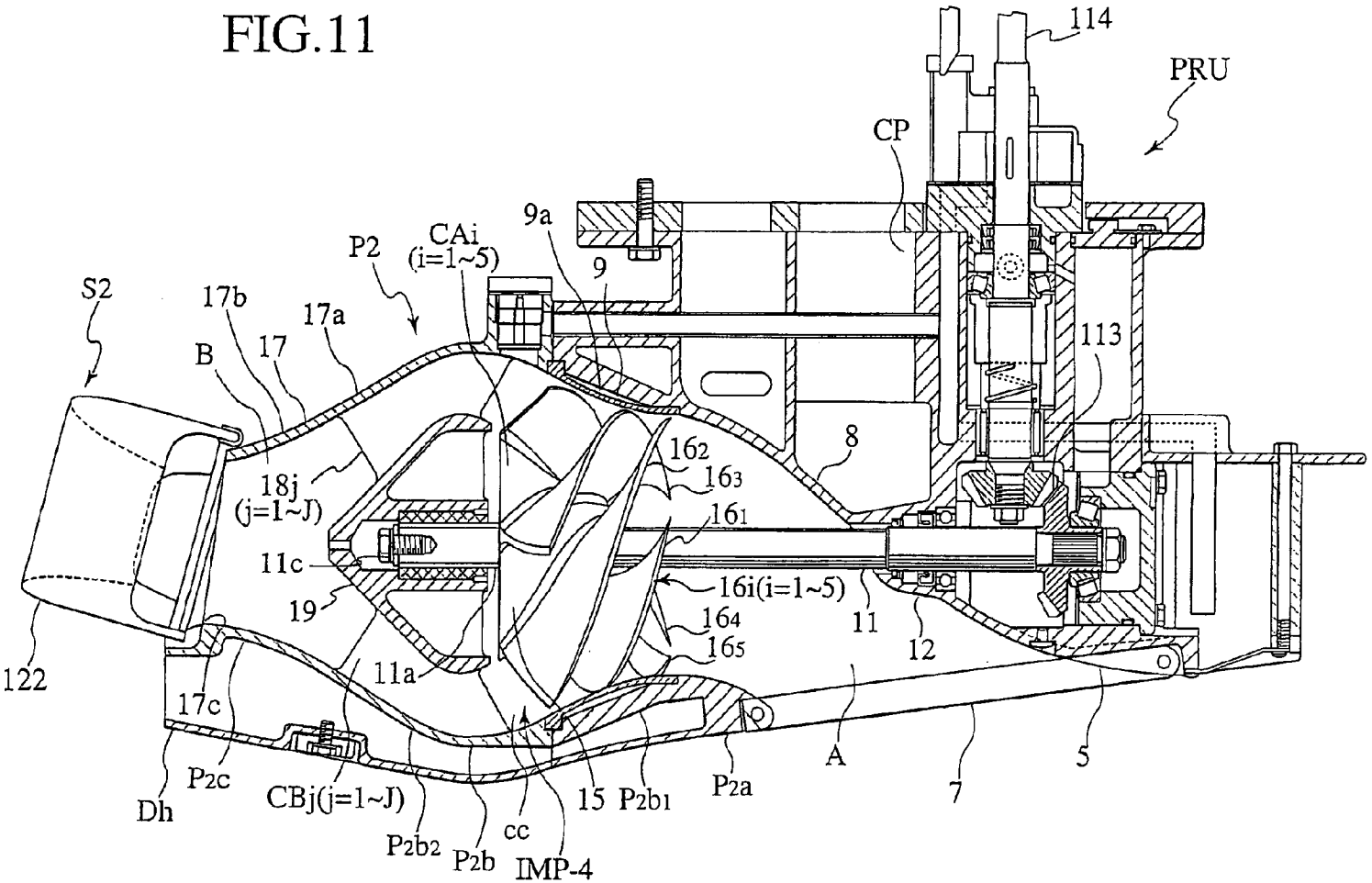
FIG. 11 is a longitudinal cross-sectional view of an essential portion of the waterjet propelling apparatus of FIG. 10.
Figure 12:
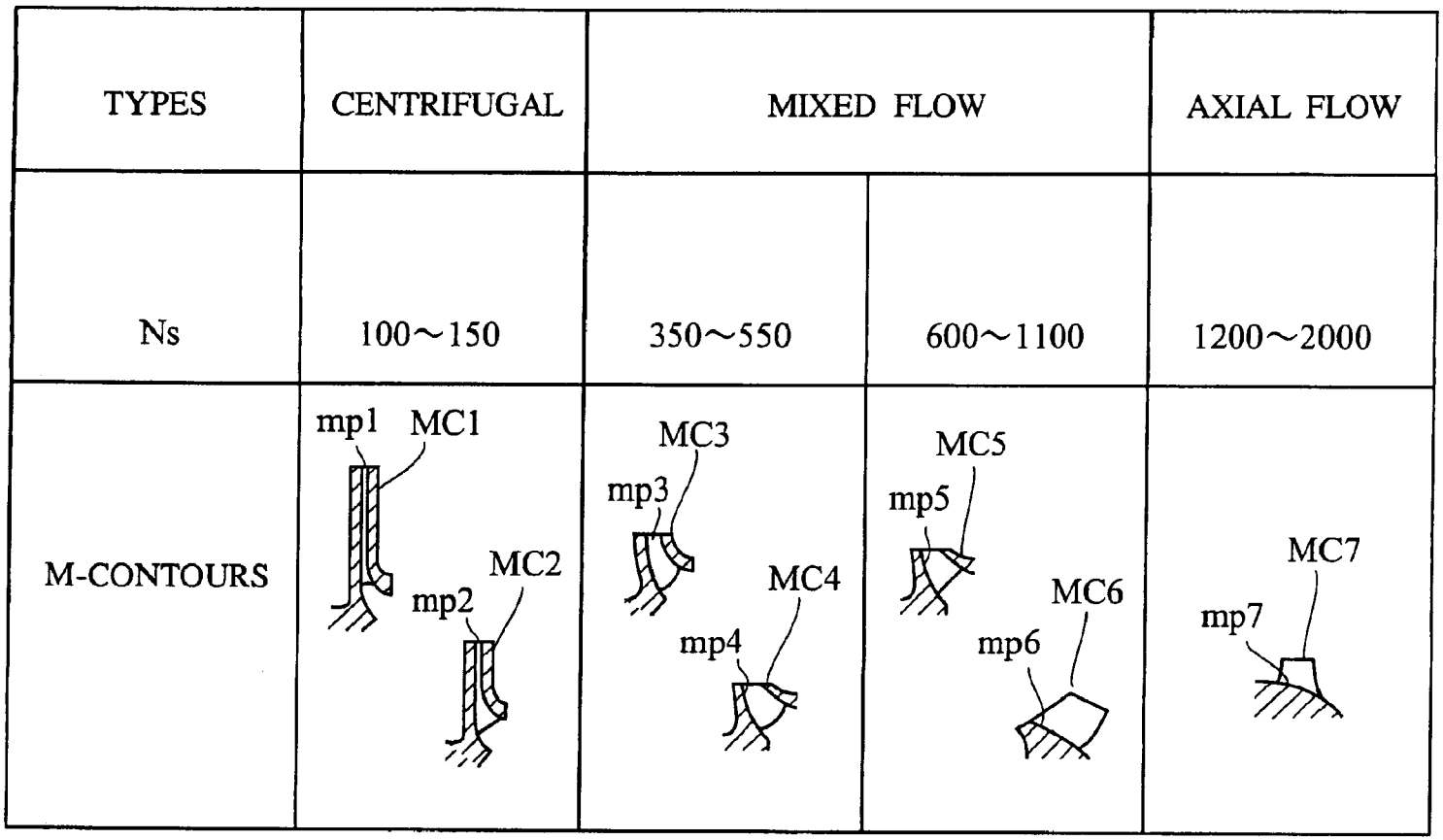
FIG. 12 is a diagram showing relationships between specific speeds Ns and meridian contours of impellers.
Figure 13:
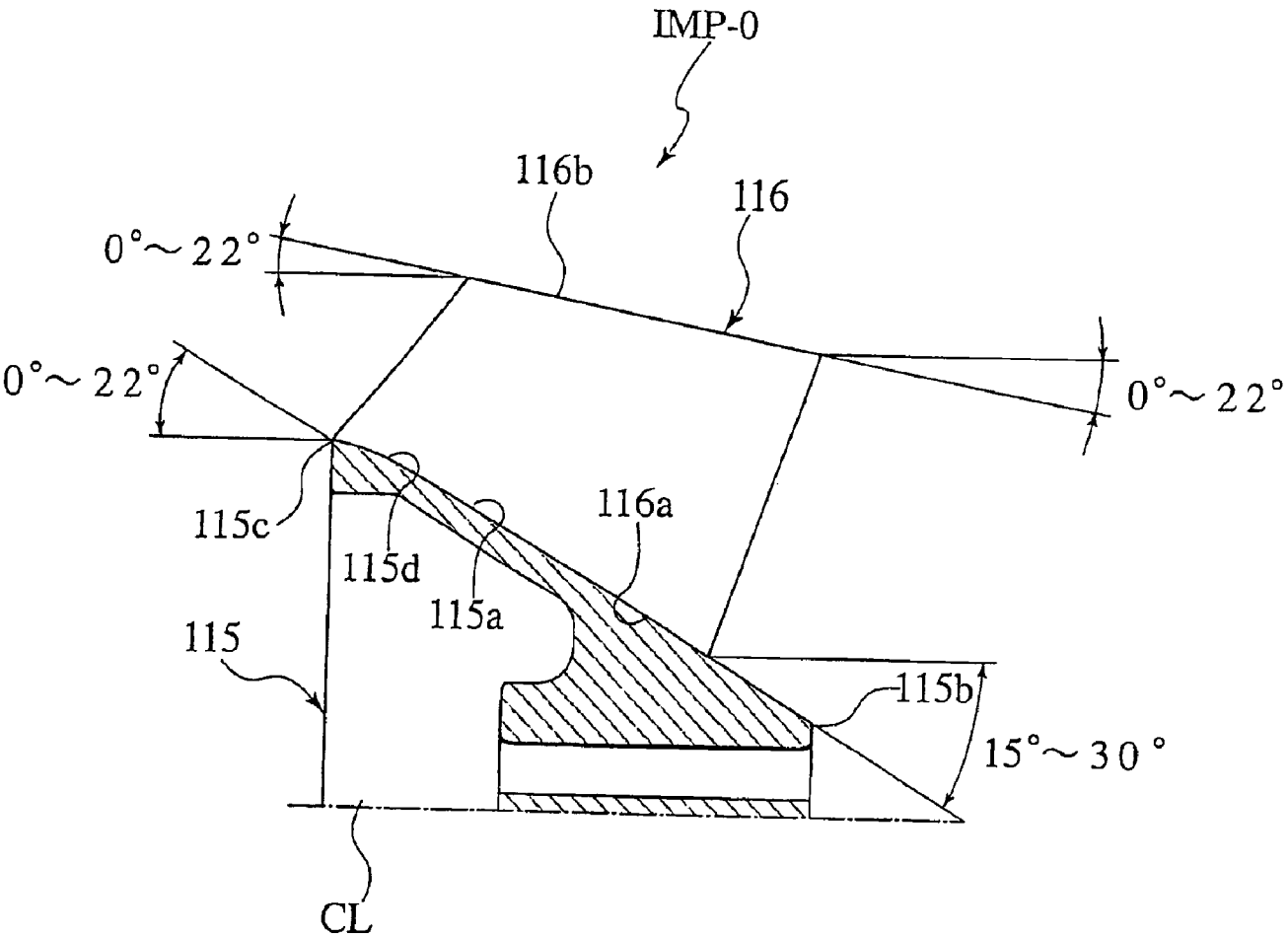
FIG. 13 is a meridian map of a conventional impeller.

FIG. 10 shows a waterjet propelling apparatus PR2 for vessels according to the second embodiment, and FIG. 11 shows a propelling unit PRU of the propelling apparatus PR2.

The waterjet propelling apparatus PR2 is configured as an outboard motor detachably attached to a stem of a high-speed vessel, and includes the propelling unit PRU for drawing water from therebelow to rearwardly discharge waterjets, thereby propelling the vessel, and a drive portion D2 attached and fixed to the stern, to integrally support and drive the propelling unit PRU pending downward.

The drive portion D2 includes a tiller-steered housing Hs with an incorporated engine, and a fixture Fx for attaching the housing Hs to the stem in a leftward and rightward pivotable manner. The housing Hs is provided with a vertical duct Dv for downwardly conducting engine exhaust gases Ex.

The propelling unit PRU is configured with a turbopump portion P2 for converting drawn water W from a suction path A into waterjets to rearwardly deliver waterjets from a delivery path B, and a steering portion S2 for controlling a discharge direction of delivered waterjets to steer the vessel (with unshown controlling system and steering system).

As shown in FIG. 11, the turbopump portion P2 includes a water drawing part P2*a* for drawing water W from the suction port 5, a waterjet generating part P2*b* for generating waterjets from drawn water W, a waterjet delivery part P2*c* for delivering generated waterjets, a horizontal duct Dh for discharging engine exhaust gases Ex from the vertical duct Dv into water, and a cooling water pipe CP for feeding pressurized swirling streams from within the waterjet generating part P2 or water W from ahead the suction port 5, as engine cooling water to the drive portion D2.

The water drawing part P2*a* has a suction casing 8, which defines an inclined suction path A communicating with the suction port 5. This suction path A is smooth, and less curved, to introduce flowing water when the vessel planes, exerting force-feed pressures on drawn water W. Note that the suction port 5 has a dust removing screen 7 extending thereover.

The waterjet generating part P2*b* is configured with a swirling part P2*b*1 for swirling drawn water W to be pressurized to thereby generate swirling streams high of head, and a rectifying part P2*b*2 as a diffuser for rectifying swirling streams into straight streams, to obtain waterjets.

The swirling part P2*b*1 has a pump casing 9 horizontally coupled to a rear end of the suction casing 8, an impeller IMP-4 installed in a bowl-shape diameter-expanded part 9*a* of the pump casing 9, and a spindle 11 for driving the impeller IMP-4.

The impeller IMP-4 includes a pear-shaped hub 15 keyed to a rear part 11*a* of the spindle 11, and a total number of I (I=5 in this case) spiral rotary vanes $\mathbf{16}_i$ (i=1 to I) (collectively, designated simply by 16) integrally formed on an outer periphery of the hub 15, for cooperation with the pump casing 9 as a shroud to define a total number of I rotary channels $CA_i$ (i=1 to I) (collectively, designated simply by CA).

The spindle 11 is water-sealingly borne by a bearing 12 provided on an outer wall of the suction casing 8, and has a front part 11*b* protruding therefrom to be coupled with a drive shaft 114 of the drive portion D2 via a bevel gear 113.

The rectifying part P2*b*2 has a front part 17*a* of a delivery casing 17 coupled to the rear end of the suction casing 8, a total number of J (J=7 to 9) stationary guide vanes $\mathbf{18}_j$ (j=1 to J) (collectively, designated simply by 18) integrally formed with the delivery casing front part 17*a*, and a vane boss 19 interconnecting inner peripheral parts of the stationary guide vanes 18 bearing the rear end part 11*c* of the spindle 11. The guide vanes 18 cooperate with the pump casing 9 and vane boss 19 to define a total number of J stationary channels $CB_j$ (j=1 to J) (collectively, designated simply by CB). The stationary channels CB communicate with the rotary channels CA via a conflux channel CC.

The waterjet delivery part P2*c* is configured with a funnel-shaped rear part 17*b* of the delivery casing 17, to define a delivery path B communicating with the stationary channels CB.

The steering portion S2 includes a reverser 122 vertically rotatably pivoted on a waterjet discharge part 17*c* of the delivery casing 17.

As is apparent from the foregoing description, according to the first or the second embodiment, when the vessel (1) runs at a high speed, running water streams under the vessel bottom (2) or propelling unit (PRU) inflow to the suction port (5) of the suction casing (8), to be transferred to an impeller (IMP-1, IMP-2, IMP-3, IMP-4) (hereinafter collectively called "IMP") in the pump casing (9).

Inducer vane portions (16*a*) extended into the suction casing (8) have a wide suction port defined at distal ends of their outer peripheries, which prevents binding such as of fibers.

The inducer vane portions (16*a*) exhibit an inducer function, of which propelling power increases the suction amount of axially inflowing fluid (W), raising force-feed pressures on mixed-flow vane portions (16*b*).

With a suction performance improved by the inducer vane portions (16*a*), the mixed-flow vane portions (16*b*) are kept free from occurrences of local pressure drops, so that vibrations or noises due to cavitation are prevented.

The mixed-flow vane portions (16*b*) pressurize fluid (W) by vane's pumping forces and centrifugal forces. Centrifugal vane portions (16*c*) additionally pressurize fluid pressurized by the mixed-flow vane portions, while preventing an increase of shaft horsepower.

The impeller (IMP) supplies thus pressurized swirling streams to the delivery casing (17), where swirling streams are rectified by stationary guide vanes (18) of the delivery casing into straight streams to constitute flux of waterjets.

I (I=4 to 6) rotary vanes (16) are equi-pitched to be wound around the hub (15) and axis-symmetrically arranged, with a favorable balance, and with a favorable volumetric efficiency to provide fluid with energy.

It was difficult for conventional centrifugal vanes to have a suction-end specific speed, which represents the suction performance to be conforming or non-conforming in quality, increased over 2,000. However, according to the embodiments described, the provision of rotary vanes (16) with inducer vane portions (16*a*) allows the impeller (IMP) to have a suction-end specific speed of 2,300 $min^{-1}\cdot(m^3/min)^{1/2}\cdot m^{-3/4}$, this improvement of suction performance enabling prevention of occurrences of cavitation, and a high-speed rotation. Further, light-weighted propelling apparatus (PR1; PR2) allows a high-head, large-capacity delivery, with enabled application as well to high-speed vessels middle or large in scale.

According to the embodiments described, a waterjet propelling apparatus (PR1; PR2) includes a pump casing (9) diameter-expanded to be bowl-shaped from upstream to downstream, for accommodating therein an impeller (IMP), of which a respective rotary spiral vane (16) is configured as a collision-lees connection of an axial-flow type of inducer vane portion (16*a*) extended to an end of a suction casing (8), a mixed-flow vane portion (16*b*) with a moderate slope, and a centrifugal vane portion (16*c*) with a steep slope, to define a rotary channel (CA) describing a smooth curve from the inducer vane portion (16*a*) disposed upstream to the centrifugal vane portion (16*c*) disposed downstream, allowing for an improved suction performance due to an inducer effect at an inlet of the vane, and preventing a great increase of shaft horsepower due to a centrifugal effect at an outlet of the vane. A resultant great-capacity, high-head turbopump has reduced variations, allowing a high-speed rotation of the impeller (IMP).

The rotary vane (16) of impeller (IMP) has the centrifugal vane portion (16*c*) wound around a steeply sloping rear stage portion (15*e*) of a hub (15), the mixed-flow vane portion (16*b*) wound around a moderately sloping front stage portion (15*d*) of the hub (15), and the inducer vane portion (16*a*) of axial-flow configuration continuously formed upstream the mixed-flow vane portion (16*b*) to increase the suction amount of fluid, with increased force-feed pressures on the mixed-flow vane portion (16*b*), preventing vibrations and noises due to cavitation.

Respective rotary vanes (16) have, as they are in a meridian map, an outer side (16*d*) thereof brought close to an inner periphery of the pump casing (9), which outer side (16*d*) has an upstream end (16*du*) thereof, i.e., a distal end of the inducer vane portion (16*a*), projecting toward a suction path A, thereby rendering the suction port wide, with an enhanced suction performance.

A total number of I (I=4 to 6) rotary vanes (16) are equi-pitched to be wound around the hub (15), with a favorable volumetric efficiency to provide fluid with energy, and with a favorable rotation balance.

The suction casing (8) is configured to define a moderately sloping suction path (A) to be smooth and less curved, for the draw-in of running water to be favorable when vessel planes, with increased force-feed pressures.

The impeller (IMP) is single-staged, and light in weight relative to a double-staged pump configuration of conventional propelling apparatus, and has an advantage in application to high-speed vessels.

A rectifying portion (P1*b*2, P2*b*2) is configured with a total of J (J=7 to 9) stationary guide vanes (18) arranged between the delivery casing (17) and a vane boss (19) to define stationary channels (CB) as return channels from a centrifugal direction to an axial direction, preventing the occurrence of radial loads as would have been in a vortex chamber, thus reducing vibrations.

INDUSTRIAL APPLICABILITY

According to the present invention, there can be provided a waterjet propelling apparatus for vessels, applicable to a high-speed vessel relatively large in scale.

What is claimed is:

1. A waterjet propelling apparatus for vessels, configured as a single-staged turbopump including an impeller having rotary vanes wound around a hub, and a pump casing configured to accommodate the impeller, wherein a rotary vane comprises an axial-flow vane portion with an inducer-joined configuration, a mixed-flow vane portion collisionlessly connected to the axial-flow vane portion, and a centrifugal vane portion collisionlessly connected to the mixed-flow vane portion, the hub including an outer continuously curved peripheral surface having a moderate slope region and a steep slope region, the axial-flow vane portion and the mixed-flow vane portion of the rotary vane are wound around the moderate slope region of the outer peripheral surface of the hub, the centrifugal vane portion of the rotary vane is wound around the steep slope region of the outer peripheral surface of the hub, and the axial-flow vane portion of the rotary vane has an inducer part of a triangular curve form confronting a downstream end of a straight-tubular portion of the pump casing, and protruding upstream of a front stage portion of the hub.

2. The waterjet propelling apparatus for vessels as claimed in claim 1, wherein the moderate slope region of the outer periphery of the hub is located upstream of the steep slope region.

3. The waterjet propelling apparatus for vessels as claimed in claim 1, wherein the rotary vane has a meridian map of an irregular quadrilateral form defined by an outer side and an inner side, and the outer side of the rotary vane has a progressively increased distance relative to the inner side, as the outer side extends from a downstream end thereof toward an upstream end thereof.

4. The waterjet propelling apparatus for vessels as claimed in claim 1, comprising a moderately sloping suction path.

5. The waterjet propelling apparatus for vessels as claimed in claim 1, wherein between 4 and 6 rotary vanes are provided.

6. The waterjet propelling apparatus for vessels as claimed in claim 5, comprising stationary vanes arranged downstream the rotary vanes, wherein between 7 and 9 stationary vanes are provided.

* * * * *